United States Patent [19]

Tarsoly

[11] 4,141,671

[45] Feb. 27, 1979

[54] TOOL GAS TURBINE MOTOR

[76] Inventor: Balazs K. Tarsoly, 52 Maple Pl., Amitville, N.Y. 11701

[21] Appl. No.: 789,234

[22] Filed: Apr. 20, 1977

[51] Int. Cl.[2] ..... F01D 5/00

[52] U.S. Cl. ..... 415/72; 415/123; 173/163; 408/124; 51/134.5 F

[58] Field of Search ..... 415/72, 73, 74, 75, 415/25, 123, 140, 501, 503; 173/163; 408/124; 51/134.5 F

[56] References Cited

U.S. PATENT DOCUMENTS

| | | | |
|---|---|---|---|
| 2,492,966 | 1/1950 | Ckola | 415/72 |
| 2,808,225 | 10/1957 | Johnson | 415/72 |
| 2,855,671 | 10/1958 | Lundgreen et al. | 415/503 |
| 2,893,688 | 7/1959 | Shada | 415/74 |
| 3,021,723 | 2/1962 | Happe | 408/124 |
| 3,128,079 | 4/1964 | DeGroff | 415/123 |
| 3,383,805 | 5/1968 | Powell | 51/134.5 F |
| 3,609,058 | 9/1971 | Tarsoly | 415/104 |
| 3,712,386 | 1/1973 | Peters | 415/123 |
| 3,918,535 | 11/1975 | Eklof et al. | 173/163 |
| 3,935,909 | 2/1976 | Mabuchi et al. | 51/170 PT |

*Primary Examiner*—C. J. Husar

[57] ABSTRACT

In a preferred embodiment, a drill gas turbine motor in which the housing structure directs pressurized gas both radially inwardly and axially along the longitudinal axis of the elongated housing, against vanes arranged along a circumscribing surface of the revolvable (rotatable) rotor mounted within rotor space within the housing to effect rotation of the rotor, and a drivable shaft extending from an opening at one end of the housing, and a dampening-spring mechanism at an opposite end of the housing and rotor arranged to dampen pressure and movement of the rotor in a direction away from the end of the drivable shaft thereby reducing wear on bearings supporting the rotar at opposite ends thereof, together with brake mechanism for manually exerting braking pressure against the rotor, and key mechanism for locking the rotor in a non-revolvable state during change of chuck on the drivable shaft, and the drivable shaft having formed in a distal end thereof a female receptacle receivable of a male end of a chuck.

2 Claims, 4 Drawing Figures

TOOL GAS TURBINE MOTOR

This invention relates to a gas turbine motor device for a drill to drive a chuck.

BACKGROUND TO THE INVENTION

Heretofore there have existed certain inherent difficulties in gas-driven gas turbine motor which are not analagous to the situations encountered with electrically and mechanically-driven drills. The required lack of resistance to easy rotation by the impinging action and force of pressurized air mandate that there be a minimum of artificial resistance, and that rotation be free and uninhibited substantially. Accordingly, when pressure is applied along a longitudinal axis thereof, in typically the driving of a chuck in a drilling operation, wearing pressure and friction resulting therefrom on the supporting bearings supporting the rotor at each of opposite ends of the rotor space, is excessive, resulting in poor durability and life of the motor. Also, because of the need for maximum effect of the pessurized air, or other driving gas, it is desirable to arrange the housing to achieve maximum drive — this being a goal not heretofore fully achieved, it has been found in accord with the present invention. From the standpoint of both safety and convenience, it is highly desirable to have some appropriate mechanism for holding steady the chuck-driving shaft and driving rotor thereof during the handling or changing of the chuck, no such device or mechanism existing heretofore.

SUMMARY OF THE INVENTION

Accordingly, objects of the present invention include the overcoming of one or more of the above-noted problems and difficulties and disadvantages, together with novel improvements and advantages.

In particular, in order to off-set any loss of drive that might result from braking-effect of a spring or dampening mechanism directed to reduce wearing pressure on the bearings, it is important and an object of the invention to enhance the efficiency of driving force of pressurized gas in the driving of the rotatable rotor.

Another object is to obtain a dampening mechanism for effectively reducing wear and tear on supporting bearings, while being of a nature as to not impede significantly rotation of the rotor of an air or other gas-driven type.

Another object is to include a braking mechanism of simple and inexpensive cost, while having a high efficiency in promply reducing the high rate of revolutions quickly, such high number of revolutions per minute being characterized by increased difficulty in prompt braking by convention mechanism, particularly in dealing with a motor of gas turbine nature where the braking mechanism must not be of a type that consistently binds and that would consistently brake or retard required high rate of rotation necessary for an effective gas turbine motor for a drill.

Another object to obtain a simple lock mechanism also devoid of complications and structures described above which would increase cost and/or decrease normal operating efficiency and effectiveness, while being easily institutable for the locking of the rotor and shaft driven thereby, against accidental rotation and against movement when working with the chuck in a change thereof.

Another object is to improve the drilling effectiveness and perfection of work when utilizing a gas turbine motor, which by its air-driven and suspended-nature, the rotor thereof and therefore the driven chuck thereof are very susceptable to vibrations and resulting in imperfect work, together with the loosening of the chuck; accordingly, improved seating of the chuck is an ultimate object which, together with other features above-noted of this invention, serve to obtain an improved combination, and work-result obtained therefrom.

Other objects become apparent from the preceding and following disclosure.

One or more objects of the invention are obtained by the typically-illustrated embodiments of the present figures which are not intended to limit the scope unduly merely to these examples given for the sole purpose of improved understanding of the heart of the invention, entitled to scope within obvious modifications and equivalents of a person skilled within this art.

Accordingly, broadly the invention may be defined as a gas turbine motor, particularly beneficial in a drill type device, of a conventional type and structure, in which the improvements include housing structure arranged to direct pressurized gas such as pressurized air radially inwardly and concurrently axially along a longitudinal axis of an elongated housing into rotor space defined (formed) within the housing having at least one open end through which the drivable shaft extends for the driving of a chuck, and biased against one end of the rotor or shaft thereof, at an end opposite from the open end of the drivable shaft, there being a preferably annular-in-nature spring element preferably in the nature of spring steel or other heat-resistant material possibly of plastic and preferably having a smooth surface with preferably Teflon (trademark) or equivalent slippery surface material enhancing reduced friction and/or heat, biased against outer portion(s) of the bearing(s) and/or of the housing structure, in a substantially free-floating position engagable to offer spring-resistance against axial movement of the rotar away from the open end of the drivable shaft at such times as the drivable shaft is pressed against an object being drilled by a chuck, and drill piece thereof. The above-described spring element constitutes a preferred embodiment of the invention.

The chuck-end of the rotor shaft preferably includes a female receptacle for receiving the male upper end of a drill work piece, thereby preventing and/or substantially reducing vibrations and/or wobbling of the drill workpiece at the end of the air or gas turbine-driven floating rotor and shaft thereof.

When in need of proceeding promptly to change a drill piece or otherwise handle the chuck, for an uninhibited rotor and shaft thereof particularly of a gas-driven turbine motor drill, where for such type drill the rotating shaft is slow to slow-down, there is need to rapidly and safely reduce rate of rotation or stop rotation, devoid of problems of braking structure of a complicated nature or nature that would always to some extent inhibit normal rotation. The present invention includes at the top end of the drill housing, a manually pressible button and shaft thereof, normally spring-biased into a non-engaging state, and a friction face or pan on the end of the shaft, for the pressing of the friction pan or face against an upper face of the shaft's upper end, thereby dragging against the rotating end to slow and stop the rotor from its rotation. This described mechanism is a preferred embodiment.

Associated preferably with the breking end of the housing, there is also a locking mechanism for preventing the accidental rotation during intended non-use and/or during manipulation of the chuck as typically during the changing of a work piece. Again, as a functional part of the whole, devoid of normally-inhibiting structure or mechanism and simple and low cost in achieving, is the one or more housing apertures aligned with a shaft preferably through aperture and a pin or key, for the easy-insertion therethrough, for the locking of the rotor shaft and rotor against any rotation until after removal of the pin/key.

The invention may be better understood by making reference to the following merely illustrative and diagrammatic figures.

THE FIGURES

DETAILED DESCRIPTION OF THE INVENTION

Figure 1:
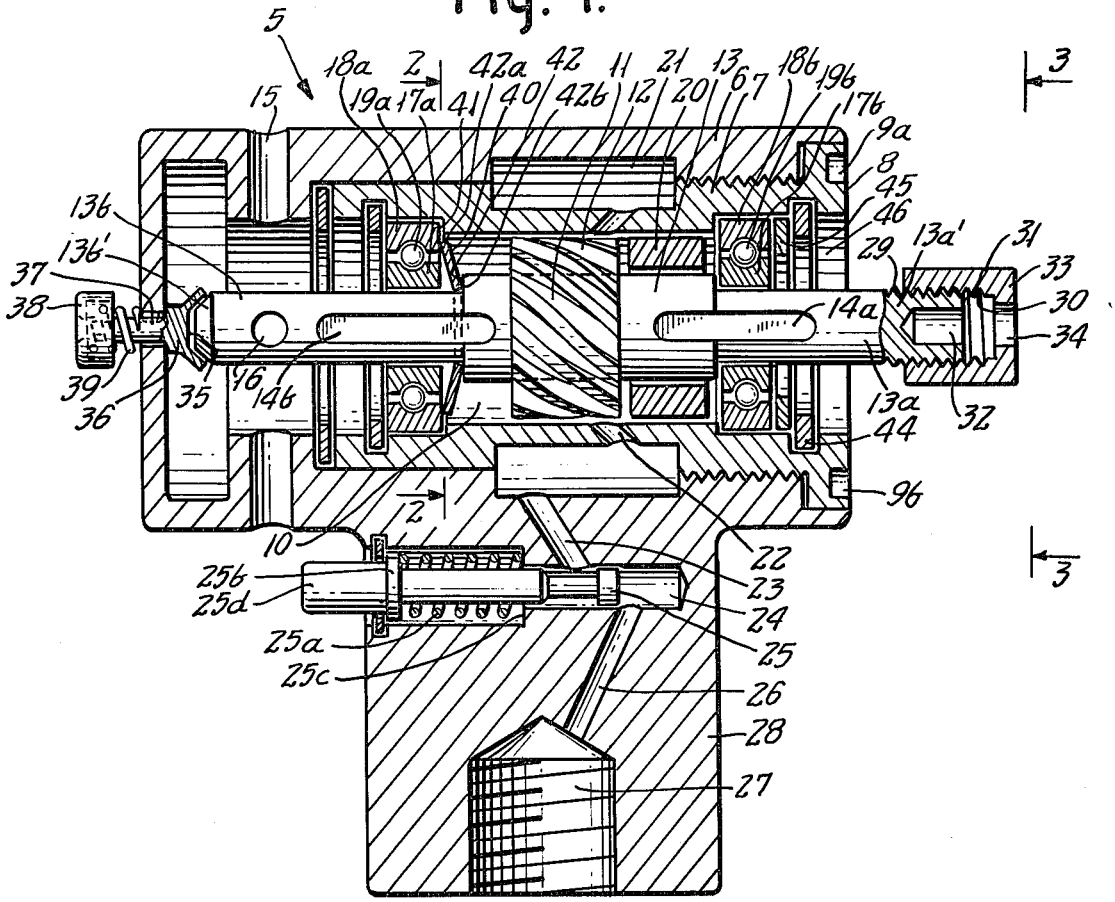
FIG. 1 illustrates in diagrammatic representation, a side in-part cross-sectional view of a preferred embodiment of the present inventive gas turbine motor device.
Figure 2:
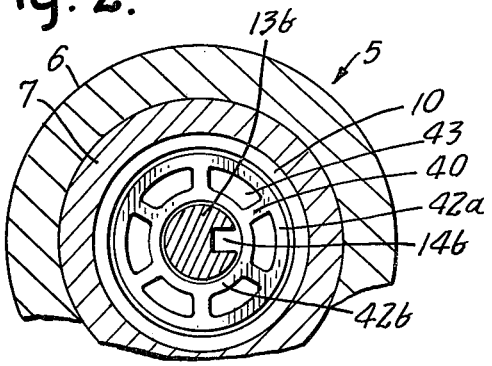
FIG. 2 illustrates in in-part view a cross-section as taken along lines 2—2 of FIG. 1, including an elevation front view of the dampening-spring element mounted around the rotor shaft.
Figure 3:
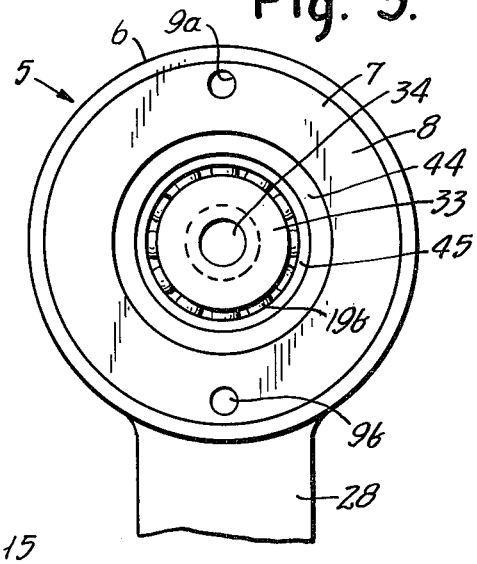
FIG 3 illustrates an in-part and elevation front view of the face and structure of the working-end of the gas turbine motor device.
Figure 4:
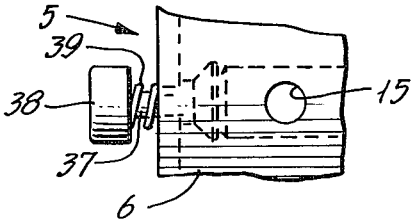
FIG. 4 illustrates an in-part and top view of the embodiment of FIG. 1, illustrating the pin/key-locking aperature structure.

In greater detail, the FIGS. 1 through 4 illustrate a common embodiment of a gas turbine motor device 5, the several figures merely emphasizing and illustrating different parts thereof. Thus, hereafter, no particular figure will normally be referred to.

The outer-sleeve housing 6 has inner female threads which mate with male threads of an inner sleeve structure 7 having forward face 8 with fork-wrench holes formed within the forward face 8, as fork-wrench holes 9*a* and 9*b*. The inner sleeve structure 7 is tubular thereby defining an inner space 10 within which a rotor 11 is mounted. The rotor 11 has helical vanes 12. Between the outer-sleeve housing 6 and the inner sleeve structure 7 is formed an air or gas-channel space 21 and a conduit, preferably plurality thereof, 22 angled radially inwardly and also toward one end of the gas turbine motor device so as to cause gas passing therethrough to strike the vanes 12 at optimum driving vectors, the vanes 12 being pitched at optimum predetermined pitch relative to pressurized gas impinged thereagainst. Thereby the rotor 11 is caused to revolve, and being fixedly mounted on the shaft structure 13, causes the revolving rotor to be stabilized during rotation thereof, the shaft ends 13*a* and 13*b* extending oppositely and being revolvably mounted within bearing structures including inner bearing structures 17*a* and 17*b*, with bearings 19*a* and 19*b*, and outer bearing structures 18*a* and 18*b* floating on & cooled by air passing therethrough. Slots 14*a* and 14*b* facilitate the escape of pressurized air from the inner space 10, the air (or other gas) passing also through the holes 43 between legs 40 of the inner ring structure 42*b* and outer ring structure 42*a* of the dampening-spring element, the portion 42*b* pressing occasionally against the face 42 of the shaft structure 13, and the portion 42*a* pressing occasionally against the face 41 of the outer bearing structure 18*a* — normally the dampening-spring element being a floating member around the shaft end 13*b*, the dampening-spring element exerting resisting biasing pressure when the face 42 is pressed thereagainst as a result of pressure against the chuck 33 during drilling or the like.

Formed within the non-working end of the outer-sleeve housing 6, is a pin-receiving hole 15 through-which any suitable pin, nail, rod, screw-driver, or the like may be inserted, and further inserted through the female receptacle 16 of the shaft end 13*b*, whenever the female receptacle is caused to be aligned with the pin-receiving hole, whereby the rotor and shaft and shaft ends thereof are prevented from rotating or revolving until after the locking pin, nail, etc. is removed. Floating ring 20 is conventional, and serves to more homogeneously distribute escaping pressurized air or other gas from the space(s) 10 moving toward the bearing structures 17*b*, 18*b* and ball bearings 19*b*. Air or other pressurized gas is channeled to space 21 through channel 23 from the switch space 24 whenever the sealing disk structure 25 is caused to move (be pressed) deeper into the space 24 past the conduit channel 26 fed air or other gas from air-tube fastener structure space 27 of the handle 28. The sealing disk structure becomes pressed inwardly against outwardly biasing spring 25*a*, by push-in pressure on button 25*d* whereby the flange 25*b* compresses the spring 25*a*, and eventually the passage of air or other pressurized gas is permitted to be fed into the space 21.

The working-end shaft end 13*a* has male threads 29 which mate with female threads 30 of the chuck 33 having central through-aperture 34 aligned with tool-receiving hole 32 at the terminal end of the shaft end 13*a* as hole-forming structure 13*a*'.

At an opposite end, at the terminal end of the shaft end 13*b*, there is angular face 13*b*' formed, shaped to fit receptacle face surface 35 of braking structure 36, such that when the surface 35 is pressed against face 13*b*', by pressing button 38 against the biasing spring 39 to move axially inwardly shaft 37, rotation of the shaft end 13*b* and of shaft end 13*a* and the rotar shaft 13 and the rotor 11 and vanes 12 and chuck 33, all are caused to become thereby braked.

Locking ring 44 secures — prevents outward movement — of the safety plate ring disk structure 45 which overlaps the outer bearing structure 17*b* and partially (at-least) the spaces between the inner and outer bearing structures 17*b* and 18*b*, whereby a hazard of fragmented ball bearings and/or of bearing structures is effectively reduced if not eliminated, in the event of dissentigration of bearing mechanism at the open and working end of the outer sleeve housing 6.

It is within the scope of the invention to make such variations and modifications and substitution of equivalents as would be apparent to a person of ordinary skill, in this art.

I claim:

1. A gas turbine motor comprising in combination: a substantially cylindrical stator housing forming therewithin a rotor space and having an open end at at-least one of opposite ends thereof; means for supplying pressurized gas to the housing into said rotor space at substantially one of said opposite ends; a rotor comprising a generally cylindrical member having helically-arranged vanes extending circumscribingly along an outer surface of the cylindrical member along a longitudinal axis thereof and being rotatably disposed inside the housing within the rotor space such that the presurized gas impinges onto the vanes to turn the rotor;

gas-directing means for receiving gas supplied and to direct supplied pressurized gas concurrently radially inwardly and axially against said vanes in an axial direction of the longitudinal axis of the cylindrical member; a shaft means extending axially of the rotor along the longitudinal axis thereof, for engagement by a driven load, the shaft means being mounted drivably at one end thereof to be driven by the rotor and extending outwardly through said open end at said one end; bearing means at opposite ends of said cylindrical member arranged to support the shaft means rotatably within opposite ends of the housing; an annular ring loosely-mounted around said shaft means, between said helically-arranged vanes and said bearing means; said vanes being pitched at a predetermined pitch to cooperate with pressurized gas to be impinged thereagainst; dampening-spring means for resiliently resisting within said space, movement of the rotor axially along its longitudinal axis in a direction away from said open end of said one end, positioned between an enlarged portion of said rotor and said bearing means within said rotor space at an opposite end from said opening; a safety plate means of annular shape mounted within said open end of said one end at a point in juxtaposition to said bearing means at that end thereof and closer to the open end than the bearing means; and retaining means for securing said safety plate means within the housing, such that spent-bearings are trapped within the housing if a bearing should fragment during rotation of the rotor.

2. A gas turbine motor comprising in combination: a substantially cylindrical stator housing forming therewithin a rotor space and having an open end at at-least one of opposite ends thereof; means for supplying pressurized gas to the housing into said rotor space at substantially one of said opposite ends; a rotor comprising a generally cylindrical member having helically-arranged vanes extending circumscribingly along an outer surface of the cylindrical member along a longitudinal axis thereof and being rotatably disposed inside the housing within the rotor space such that the pressurized gas impinges onto the vanes to turn the rotor; in which said stator housing includes inner and outer sleeves, the outer sleeve having female inner mating threads, the inner sleeve having outer male threads, an end structure of the inner sleeve having an outer surface thereof extending substantially transversely of said longitudinal axis, said outer surface forming a plurality of fork-wrench holes adapted to facilitate the screw-in insertion of the inner sleeve into the outer sleeve; gas-directing means for receiving gas supplied and to direct supplied pressurized gas concurrently radially inwardly and axially against said vanes in an axial direction of the longitudinal axis of the cylindrical member; a shaft means extending axially of the rotor along the longitudinal axis thereof, for engagement of a driven load, the shaft means being mounted drivably at one end thereof to be driven by the rotor and extending outwardly through said open end at said one end; bearing means at opposite ends of said cylindrical member arranged to support the shaft means rotatably within opposite ends of the housing; an annular ring loosely-mounted around said shaft means, between said helically-arranged vanes and said bearing means; said vanes being pitched at a predetermined pitch to cooperate with pressurized gas to be impinged thereagainst; and dampening-spring means for resiliently resisting within said space, movement of the rotor axially along its longitudinal axis in a direction away from said open end of said open end of said one end, positioned between an enlarged portion of said rotor and said bearing means within said rotor space at an opposite end from said opening.

* * * * *